US010197940B2

(12) United States Patent
Ito et al.

(10) Patent No.: US 10,197,940 B2
(45) Date of Patent: Feb. 5, 2019

(54) IMAGE FORMING APPARATUS CHANGING MAGNITUDE OF CONTROL SIGNAL USED FOR IMAGE FORMATION

(71) Applicant: CANON KABUSHIKI KAISHA, Tokyo (JP)

(72) Inventors: Shingo Ito, Tokyo (JP); Toshihiko Takayama, Kawasaki (JP); Keisuke Ishizumi, Hiratsuka (JP); Shohei Ishio, Tokyo (JP); Kenichi Iida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/843,472

(22) Filed: Dec. 15, 2017

(65) Prior Publication Data

US 2018/0181020 A1 Jun. 28, 2018

(30) Foreign Application Priority Data

Dec. 27, 2016 (JP) ..... 2016-253133

(51) Int. Cl.
*G03G 15/02* (2006.01)
*G03G 15/16* (2006.01)
*G03G 15/00* (2006.01)

(52) U.S. Cl.
CPC ..... *G03G 15/0266* (2013.01); *G03G 15/161* (2013.01); *G03G 15/1675* (2013.01); *G03G 15/80* (2013.01)

(58) Field of Classification Search
CPC ..... G03G 15/0266; G03G 15/1675
See application file for complete search history.

(56) References Cited

U.S. PATENT DOCUMENTS

| | | | | |
|---|---|---|---|---|
| 8,600,274 | B2 | 12/2013 | Uchiyama et al. | |
| 9,195,174 | B2 | 11/2015 | Kobayashi et al. | |
| 9,329,532 | B2 | 5/2016 | Nakaegawa et al. | |
| 9,785,098 | B2 | 10/2017 | Nakaegawa et al. | |
| 2015/0003880 | A1* | 1/2015 | Ohno | G03G 15/80 399/302 |
| 2015/0016833 | A1* | 1/2015 | Nakaegawa | G03G 15/0189 399/66 |
| 2015/0023680 | A1* | 1/2015 | Nakaegawa | G03G 15/1605 399/66 |

(Continued)

FOREIGN PATENT DOCUMENTS

| | | | |
|---|---|---|---|
| JP | 2007-079071 | A | 3/2007 |
| JP | 2008-268385 | A | 11/2008 |

(Continued)

*Primary Examiner* — Sandra Brase
(74) *Attorney, Agent, or Firm* — Venable LLP

(57) ABSTRACT

In a non-image forming state, an image forming apparatus changes the magnitude of a control signal output by a control portion, and when a current supply member supplies a belt with an amount of current generated by adding, to a predetermined target current used for image formation, an amount of current that flows from a contact member to the ground and changes in accordance with the magnitude of the control signal, the image forming apparatus acquires the magnitude of the control signal generated when the current, which is supplied from the current supply member to the belt and flows to a voltage adjusting member from the belt via the contact member, becomes zero.

15 Claims, 16 Drawing Sheets

(56) References Cited

U.S. PATENT DOCUMENTS

| | | | | |
|---|---|---|---|---|
| 2015/0023681 | A1* | 1/2015 | Shida | G03G 15/0131 399/66 |
| 2016/0048096 | A1* | 2/2016 | Katagiri | G03G 15/0189 399/66 |
| 2018/0039198 | A1 | 2/2018 | Saito et al. | |
| 2018/0039209 | A1 | 2/2018 | Ishizumi et al. | |

FOREIGN PATENT DOCUMENTS

| | | | |
|---|---|---|---|
| JP | 2013-213990 | A | 10/2013 |
| JP | 2013-213995 | A | 10/2013 |

* cited by examiner

IMAGE FORMING APPARATUS CHANGING MAGNITUDE OF CONTROL SIGNAL USED FOR IMAGE FORMATION

BACKGROUND OF THE INVENTION

Field of the Invention

The present invention relates to an image forming apparatus which uses an electrophotographic system.

Description of the Related Art

As an image forming apparatus such as a copier and a laser beam printer, an image forming apparatus having a configuration to use an endless belt used as an intermediate transfer member is known. As a first transfer step, this image forming apparatus transfers a toner image, which is formed on the surface of a photosensitive drum used as an image bearing member, to the belt by applying voltage from a voltage power supply to a primary transfer member disposed in a portion facing the photosensitive drum. Then this primary transfer step is repeatedly executed for toner images of a plurality of colors, whereby toner images of a plurality of colors are formed on the surface of the belt. Then as a secondary transfer step, the image forming apparatus collectively transfers the toner images of the plurality of colors formed on the surface of the belt, to the surface of a recording material (e.g. paper) by applying voltage to the secondary transfer member. The toner images collectively transferred are permanently fixed to the recording material by a fixing unit, thereby a color image is formed.

Japanese Patent Application Publication No. 2013-213990 discloses a configuration which allows downsizing and cost reduction of an image forming apparatus by not individually providing a power supply for the primary transfer and which also can change the potential on the surface of the belt. In this configuration, a circuit, which includes a plurality of Zener diodes having different setting voltages, is disposed between the belt and the ground, and the potential on the surface of the belt is changed by changing the number of Zener diodes to be operated depending on the operation environment, so as to stabilize the primary transfer efficiency.

SUMMARY OF THE INVENTION

Generally, the primary transfer portion is interposed among a plurality of members, such as the photosensitive drums, the intermediate transfer member (belt) and the primary transfer member, and the optimum primary transfer voltage changes depending on the surrounding environment. This is because, in general, the transfer current flows easily in a high temperature/high humidity environment, and the transfer current flows less smoothly in a low temperature low humidity environment. In the case of the configuration of Japanese Patent Application Publication No. 2013-213990, in order to ensure the optimum primary transferability, the surrounding environment is detected, and the number of Zener diodes, which function as a voltage maintaining unit, are switched, while finely adjusting the potential on the surface of the photosensitive drums. However, the optimum primary transfer voltage also changes depending on the duration of use of each member, such as for the intermediate transfer member, the primary transfer member and the photosensitive drums, hence it is difficult to determine the optimum primary transfer voltage by detecting the surrounding environment alone. For example, if a resistance of the intermediate transfer member increases due to the duration of use, the impedance of the primary transfer portion increases and the primary transfer field becomes weaker, therefore the optimum primary transfer voltage increases. If the film thickness of the photosensitive drum decreases because the film thickness wore down due to the duration of use, on the other hand, the primary transfer field becomes stronger, therefore the optimum primary transfer voltage decreases.

It is an object of the present invention to provide an image forming apparatus which allows to set the potential on the surface of the intermediate transfer member to be the optimum for the primary transfer, while implementing downsizing of the apparatus.

To achieve the above object, the image forming apparatus of the present invention includes:

an image bearing member that bears a developer image;

an endless belt that rotates while contacting the image bearing member;

a current supply member that contacts the belt in a rotating direction of the belt at a position different from the position where the image bearing member contacts the belt, and that supplies current to the belt;

a control portion that outputs a control signal, the magnitude of which is variable;

a contact member that contacts the belt; and a voltage adjusting portion that includes a voltage adjusting member connected to the contact member, the voltage adjusting portion being capable of changing the magnitude of the control signal that is input from the control portion, and capable of changing a magnitude of a transfer potential, which is a surface potential of the belt at a contact portion with the image bearing member and is a potential to transfer the developer image borne by the image bearing member to the belt, wherein in a non-image forming state in which image formation to form an image on a recording material is not performed, the image forming apparatus changes the magnitude of the control signal output by the control portion, and when the current supply member supplies the belt with an amount of current generated by adding, to a predetermined target current used for the image formation, an amount of current that flows from the contact member to the ground and changes in accordance with the magnitude of the control signal, the image forming apparatus acquires the magnitude of the control signal generated when the current, which is supplied from the current supply member to the belt and flows to the voltage adjusting member from the belt via the contact member, becomes zero, and the image forming apparatus performs the image formation using the control signal having the acquired magnitude.

According to the present invention, the potential on the surface of the intermediate transfer member can be set to be the optimum for the primary transfer, while implementing downsizing of the apparatus.

Further features of the present invention will become apparent from the following description of exemplary embodiments with reference to the attached drawings.

DESCRIPTION OF THE EMBODIMENTS

In the prior art, the vibration detecting unit, the vibration applying unit, the speaker and other additional composing elements are required, whereby control becomes complicated, and the cost of the process cartridge or the image forming apparatus increases.

Example 1

Figure 1:
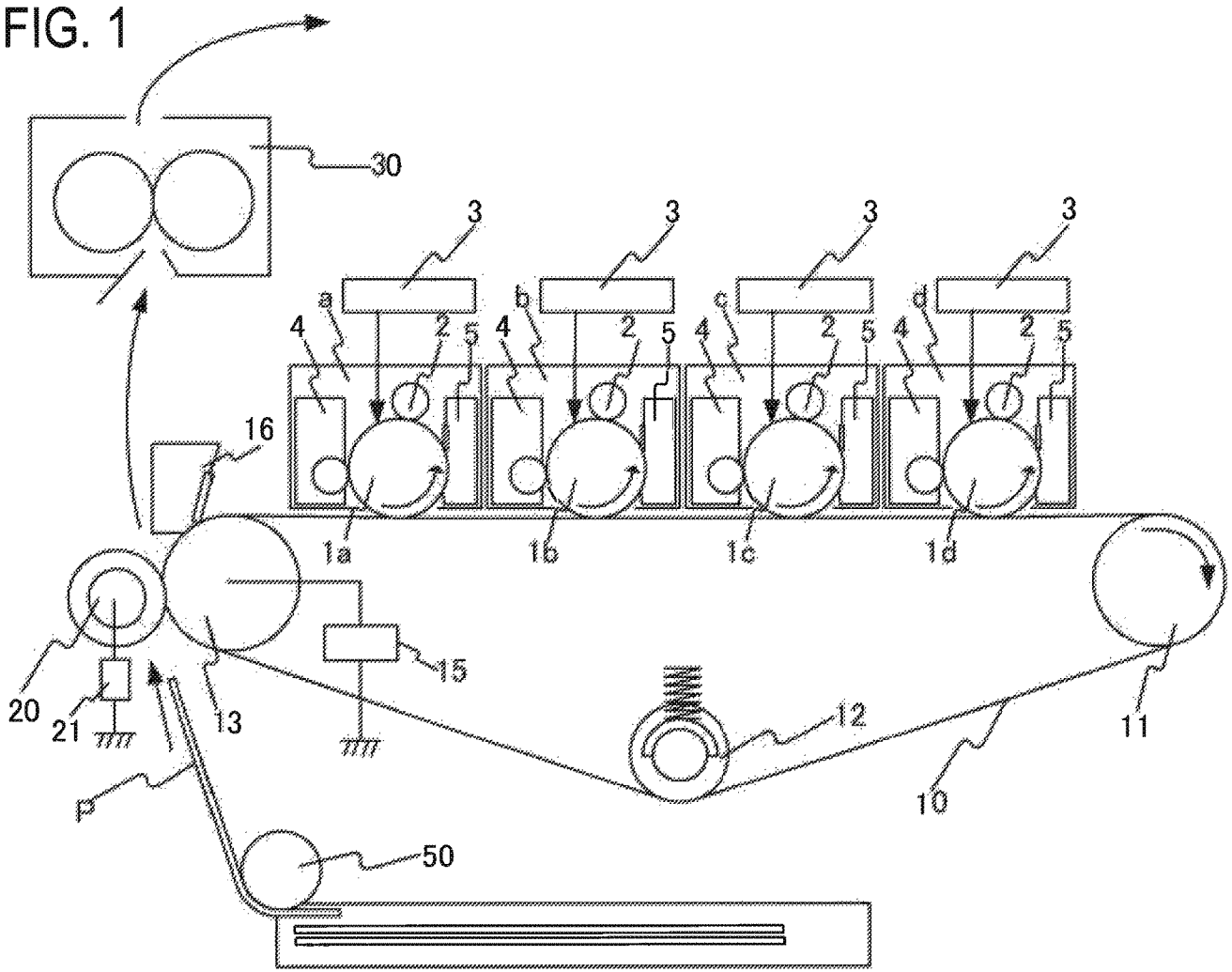
FIG. 1 is a diagram depicting an image forming apparatus of Example 1.

FIG. 1 is a schematic diagram of an image forming apparatus according to Example 1 of the present invention, and the configuration and operation of the image forming apparatus of this example will be described with reference to FIG. 1. The present invention can be applied to such image forming apparatuses as a copier and a printer using an electrophotographic system, and a case of applying the present invention to a color laser printer will be described here. The image forming apparatus of this example is a tandem type printer having a plurality of image forming stations (a to d). The first image forming station a forms a yellow image (Y), second image forming station b forms a magenta image (M), third image forming station c forms a cyan image (C), and fourth image forming station d forms a black image (Bk). Each image forming station has an identical configuration, and differs only in the color of the toner, hence this example will be described using first image forming station a.

The first image forming station a includes a drum type electrophotographic photosensitive member (hereafter called "photosensitive drum") la which is an image bearing member, a charging roller 2 which is a charging member, a developing device 4, and a cleaning device 5. The photosensitive drum 1*a* is an image bearing member which is rotationally driven in the arrow direction at a predetermined peripheral velocity (150 mm/sec), and bears a toner image (developer image). The developing device 4 is a device which contains yellow toner as a developer, and develops an electrostatic latent image formed on the photosensitive drum 1*a* using yellow toner. The cleaning device 5 is a member to collect toner adhering to the photosensitive drum 1*a*. In this example, the cleaning device 5 includes a cleaning blade which is a cleaning member that contacts the photosensitive drum 1*a*, and a waste toner box which contains toner collected by the cleaning blade.

When the image forming operation is started by an image signal, the photosensitive drum 1*a* is rotationally driven. In the rotating step, the photosensitive drum 1*a* is uniformly charged by the charging roller 2, to have a predetermined polarity (negative polarity in this example) at a predetermined potential (−500 V), and is exposed by an exposing unit 3 in accordance with the image signal. Thereby an electrostatic latent image corresponding to a yellow color component image (target color image) is formed. Then this electrostatic latent image is developed by a developing device (yellow developing device) 4 at a developing position, and is visible as a yellow toner image. Here the normal charging polarity of the toner contained in the developing device is negative polarity.

An intermediate transfer belt 10 is an endless belt by that is stretched by the stretching members 11, 12 and 13 (support members), and at a facing portion contacting the photosensitive drum 1*a*, the intermediate transfer belt 10 is rotationally driven while contacting the photosensitive drum 1*a* at an approximately same peripheral velocity in the same direction as the photosensitive drum 1*a*. The yellow toner image formed on the photosensitive drum 1*a* is transferred to the intermediate transfer belt 10 while passing through the contact portion (primary transfer nip) between the photosensitive drum 1*a* and the intermediate transfer belt 10 (primary transfer). The primary transfer method, which is the characteristic of this example, will be described later. The primary transfer residual toner that remains on the surface of the photosensitive drum 1*a* is cleaned and removed by the cleaning device 5, and is then used for the image forming process after the charging. In the same manner, the magenta toner image (second color), the cyan toner image (third color) and the black toner image (fourth color) are formed by the second, third and fourth image forming stations b, c and d, and these images are sequentially transferred to the intermediate transfer belt 10, superimposed on the previous image. Thereby a combined color image corresponding to the target color image is formed.

The four color toner images on the intermediate transfer belt 10 are collectively transferred to the surface of a recording material P, fed by a feeding unit 50 while passing through a secondary transfer nip formed by the intermediate transfer belt 10 and a secondary transfer roller 20 (secondary transfer). The secondary transfer roller 20 used here as the secondary transfer member has an 18 mm outer diameter, and is obtained by covering a nickel plated steel bar having an 8 mm outer diameter with a foamed sponge body that is mainly made of NBR and epichlorohydrin rubber and is adjusted to have a $10^8$ Ω·cm volume resistivity and a 5 mm thickness. The secondary transfer roller 20 contacts the intermediate transfer belt 10 with a 50 N applied pressure, and constitutes a secondary transfer portion (secondary transfer nip). The secondary transfer roller 20 rotates by the rotation of the intermediate transfer belt 10, and secondarily transfers the toner on the intermediate transfer belt 10 to a recording material P (e.g. paper) while current is controlled to be constant. Then the recording material P, which bears four color toner images, is introduced to a fixing portion 30, and is heated and pressed there, whereby the four toner colors are melted, mixed, and fixed to the recording material P. The toner remaining on the intermediate transfer belt 10 after the secondary transfer is cleaned and removed by the cleaning device 16. By the above operation, a full color print image is formed.

Figure 2:
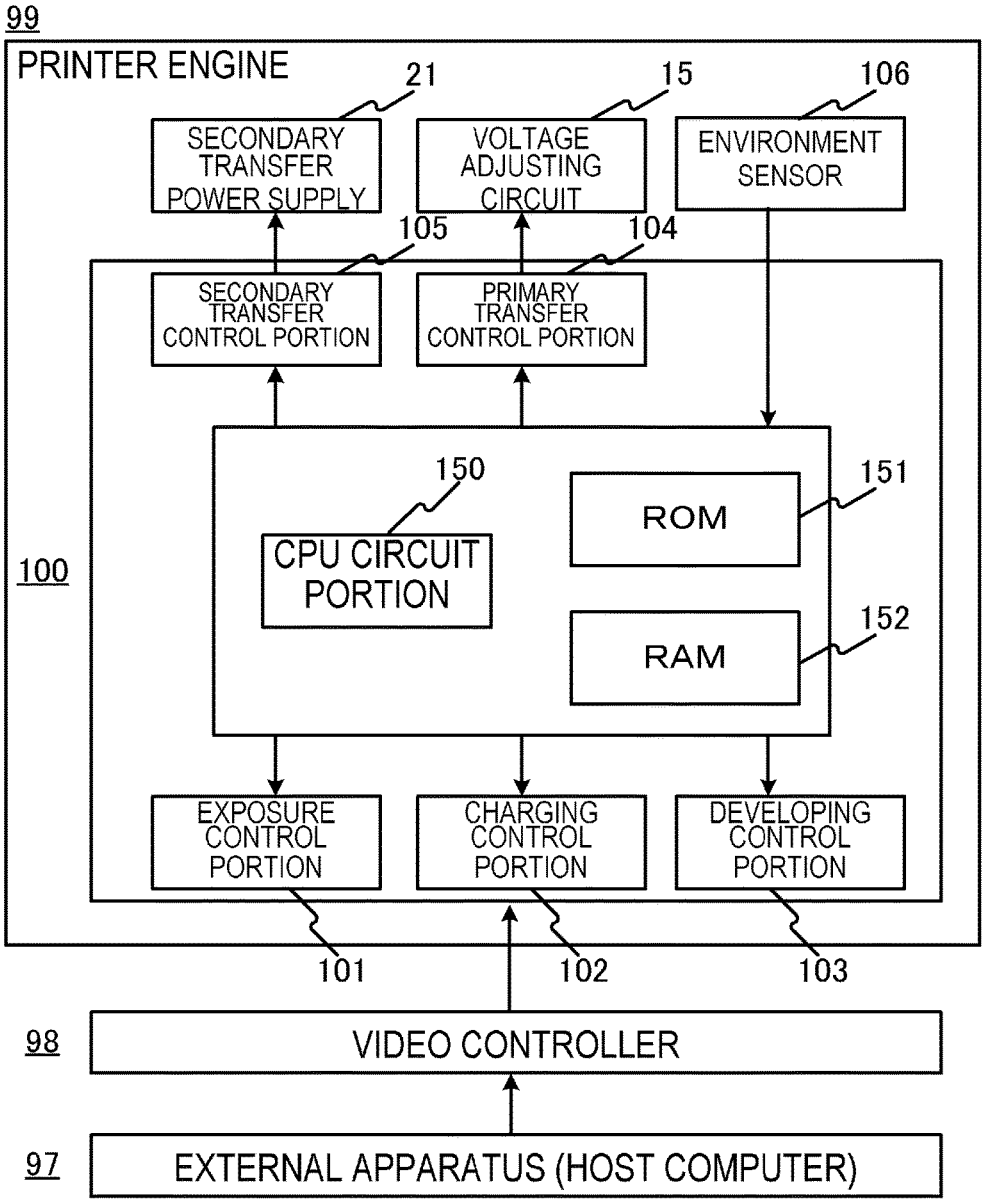
FIG. 2 is a block diagram depicting a controller related to the image formation according to Example 1.

A configuration of the controller 100, which controls the image forming apparatus main body of this example, will be described next with reference to FIG. 2. As depicted in FIG. 2, the controller 100 has a CPU circuit portion 150 which functions as a control portion. The CPU circuit portion 150 includes a ROM 151 and a RAM 152. The CPU circuit portion 150 comprehensively controls an exposure control portion 101, a charging control portion 102, a developing control portion 103, a primary transfer control portion 104, and a secondary transfer control portion 105 in accordance with a control program stored in the ROM 151. An environment table and various tables for controlling transfers are stored in the ROM 151, and the CPU calls up and uses these tables based on the information of an environment sensor 106, which is a detection unit to detect the temperature and humidity in the apparatus installation environment. The RAM 152 temporarily holds the control data, and is also used as a work area for arithmetic processing related to control. The secondary transfer control portion 105 controls a secondary transfer power supply 21, and variably controls the voltage, which is output from the secondary transfer power supply 21, based on the current value detected by a current detection circuit (not illustrated). The primary transfer control portion controls the potential of the primary transfer portion to be constant by sending a signal to a voltage adjusting circuit 15. The controller 100, the secondary transfer power supply 21, the voltage adjusting circuit 15 and the environment sensor 106 constitute a printer engine 99 of the image forming apparatus according to this example. When a host computer 97 sends image information and a printing instruction, the controller 100 receives each image signal converted by a video controller 98. Then the controller 100 controls each control portion (exposure control portion 101, charging control portion 102, developing control portion 103), and executes the image forming operation required for the printing operation.

A configuration of the primary transfer portion, which is the characteristic of this example, will be described next. This example has a configuration to perform the primary transfer by supplying current in the circumferential direction of the intermediate transfer belt 10, that is, supplying the primary transfer current in the circumferential direction (rotating direction) of the intermediate transfer belt 10 at a position different from the primary transfer nips with the photosensitive drums 1*a*, 1*b*, 1*c* and 1*d*. The intermediate transfer belt 10 and the photosensitive drums 1*a* to 1*d* form contact portions (primary transfer nips) by stretching the intermediate transfer belt 10 via the stretching rollers 11 and 13, and are connected to the voltage adjusting circuit 15 which include a transistor (voltage adjusting member) connected to the stretching roller 13. The intermediate transfer belt 10 is disposed as the intermediate transfer member, so as to face each image forming stations a to d. The intermediate transfer belt 10 is an endless belt made of resin material which is made conductive by adding a conductive agent, and is stretched around three shafts of a drive roller 11, tension roller 12, and secondary transfer counter roller 13, and is stretched by a 60N tensile force by the tension roller 12. The intermediate transfer belt 10 is rotationally driven in the same direction as the photosensitive drums 1*a* to 1*d* at facing portions contacting the photosensitive drums 1*a* to 1*d*, at approximately the same peripheral velocity as the photosensitive drums 1*a* to 1*d*.

The secondary transfer counter roller 13, which is a contact member, is connected to the voltage adjusting circuit 15, including the transistor, and functions as the voltage adjusting unit (voltage adjusting portion). The intermediate transfer belt 10 used in this example is an endless belt having a 700 mm perimeter and 90 μm thickness and molded using polyethylene terephthalate (PET) resin with an ionic conductive agent being mixed to provide conductivity to the belt. The electric characteristic of the intermediate transfer belt 10 has an ionic conductive characteristic, and electric conductivity is obtained when ions propagate between polymer chains; therefore, the resistance values of the intermediate transfer belt 10 fluctuate with respect to the temperature and humidity of the atmosphere, but are fairly even in the circumferential direction. In this example, current is supplied in the moving direction of the intermediate transfer belt to perform transfer, hence the voltage drops considerably if the resistance of the intermediate transfer belt 10 is high. Since a major voltage drop may diminish the primary transferability, it is preferable that the intermediate transfer belt 10 has a low resistance layer. In this example, the resistance of the base layer is not more than $1\times10^8$ Ω·cm (volume resistivity) in order to suppress this voltage drop in the intermediate transfer belt 10. To measure the volume resistivity, a type UR ring probe (model MCP-HTP12) is used for the Hiresta-UP (MCP-HT450) resistivity meter made by Mitsubishi Chemical Corporation. During the measurement, room temperature is set to 23° C. and room humidity is set to 50%, and the measurement is performed under the conditions of 100 V applied voltage and 10 sec measurement time. In this example, the intermediate transfer belt 10 is constituted by two layers, and by disposing a high resistance layer on the surface, current to the non-image portion is suppressed so as to further improve transferability. The present invention, however, is not limited to this configuration, but the intermediate transfer belt 10 may be constituted by a single layer, or may be constituted by three or more layers.

In this example, polyethylene terephthalate resin is used as the material of the intermediate transfer belt 10, but the present invention is not limited to this. Other materials that may be used are, for example, polyester, polycarbonate, polyarylate and acrylonitrile-butadiene-styrene copolymer (ABS). Furthermore, polyphenylene sulfide (PPS), polyvinylidene fluoride (PVdF), polyethylene naphthalate (PEN) or the like may be used as well. These materials or mixed resin thereof may be used as a material for the intermediate transfer belt 10.

In this example, the voltage adjusting circuit 15, which includes a transistor, is connected as the voltage adjusting portion between the secondary transfer counter roller 13 and the ground. The voltage adjusting circuit 15 adjusts the voltage which is applied from the secondary transfer power supply 21 to the intermediate transfer belt 10 via the secondary transfer roller 20, and generates the primary transfer voltage for performing the primary transfer in which the toner on each photosensitive drum 1*a* to 1*d* is transferred to the intermediate transfer belt 10. By applying the primary transfer voltage, which was adjusted to a desired magnitude by the voltage adjusting circuit 15, the surface potential of the intermediate transfer belt 10 reaches a desired primary transfer potential, and the primary transfer is performed by the potential difference from the surface potential of each photosensitive drum 1*a* to 1*d* (transfer contrast). The voltage adjustment performed by the voltage adjusting circuit 15 will be described in detail with reference to FIG. 3.

Figure 3:
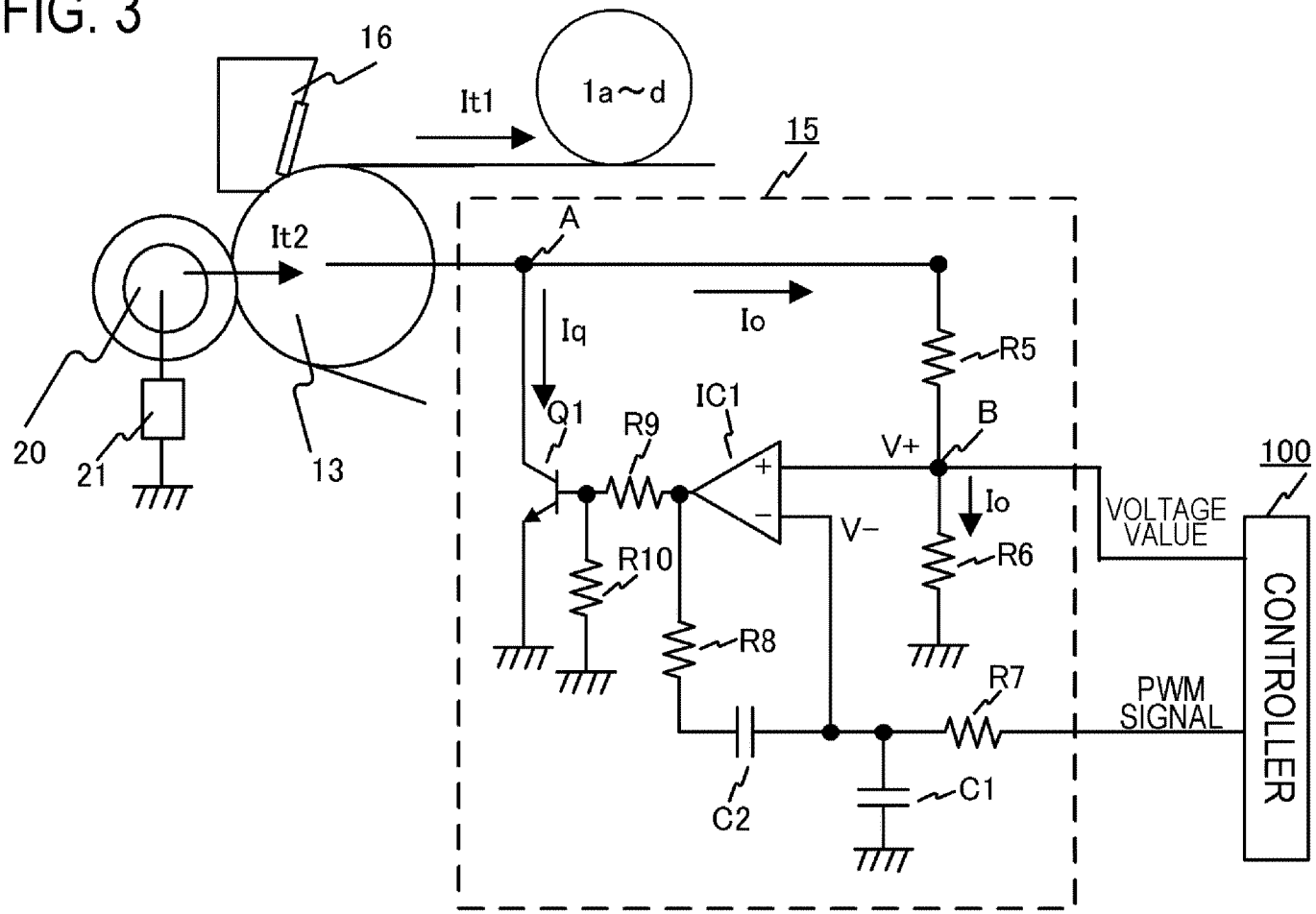
FIG. 3 is a diagram depicting a circuit of a primary transfer portion according to Example 1.

FIG. 3 is a circuit configuration of the primary transfer portion according to Example 1 of the present invention. When the secondary transfer voltage Vt2 is output from the secondary transfer power supply 21, current flows from the secondary transfer power supply 21 to the voltage adjusting circuit 15 via the secondary transfer roller 20, the intermediate transfer belt 10, and the secondary transfer counter roller 13. The voltage adjusting circuit 15 is electrically connected to the intermediate transfer belt 10 via the secondary transfer counter roller 13, and a PWM signal (control signal) is input to the voltage adjusting circuit 15 from the controller 100 (control portion). The voltage adjusting circuit 15 controls the primary transfer voltage Vt1 (potential difference between point A and the ground in FIG. 3) in accordance with the magnitude of the PWM signal input from the controller 100, that is, a value of the duty ratio.

The primary transfer voltage Vt1, which is the potential difference between point A and the ground in FIG. 3, is a potential difference between the secondary transfer counter roller 13 (surface thereof) to which the voltage adjusting circuit 15 is connected and the ground, and corresponds to the collector-emitter voltage of the transistor Q1 in the voltage adjusting circuit 15. The surface potential of the intermediate transfer belt 10, which is wound around the surface of the secondary transfer counter roller 13, is approximately the same as the surface potential of the secondary transfer counter roller 13. The collector-emitter voltage of the transistor Q1 is controlled by controlling the collector current of the transistor Q1. In other words, by controlling the collector current, the primary transfer voltage Vt1, that is, the surface potential of the intermediate transfer belt 10, is controlled. The current that is generated by applying the secondary transfer voltage Vt2 flows through the transistor Q1 as the collector current, when the voltage is applied to the base terminal of the transistor Q1.

The voltage that is input to the base terminal of the transistor Q1 to control the collector current is the output voltage of the operational amplifier IC1. A PWM signal, that is output from the controller 100, is smoothed by a resistor R7 and a capacitor C1. This smoothed control voltage V− is input to an inverted input terminal (− terminal) of the operational amplifier IC1. The output voltage of the operational amplifier IC1 is divided by resistors R9 and R10, and is input to the base terminal of the transistor Q1. As mentioned above, by applying voltage to the base terminal of the transistor Q1, the current generated by the secondary transfer voltage Vt2 flows to the transistor Q1 as the collector current, and voltage is generated between the collector and emitter, whereby the primary transfer voltage Vt1 is generated. The primary transfer voltage Vt1 generated here is divided by resistors R5 and R6, and the voltage, that is generated as the result, is input to the input terminal (+ terminal) of the operational amplifier IC1 as the monitor voltage V+. Therefore the magnitude of the primary transfer voltage Vt1 is determined in accordance with the magnitude of the control voltage V− by the function of the virtual short (V+=V−) of the operational amplifier IC1. The control voltage V− is controlled by the duty cycle of the PWM signal. In other words, if the duty cycle of the PWM signal is increased, the control voltage V− increases, and the primary transfer voltage Vt1 also increases. If the duty cycle of the PWM signal is decreased, on the other hand, the control voltage V− decreases, and the primary transfer voltage Vt1 also decreases.

As described above, in the configuration of this example, the primary transfer voltage Vt1 is determined by controlling the voltage of the transistor Q1 using the PWM signal sent from the controller 100. The resistor R8 and the capacitor C2 in FIG. 3 are disposed as elements to determine the responsiveness of the transistor Q1. In this example, in the voltage adjusting circuit 15, the controller 100 is connected to point B between the resistor R5 and resistor R6 via a signal line, having the same potential as the monitor voltage V+, so that the monitor voltage V+ can be monitored. In the configuration of this example, the controller 100 connected to point B corresponds to the control portion of the present invention, and also functions as the detecting portion which detects the potential of the contacting member. The controller 100 can determine (acquire) the actual value of the primary transfer voltage Vt1 by the following expression based on the monitor voltage V+ used for the monitoring.

$$V_{t1} = \frac{R5 + R6}{R6} V_{+}$$

The value of R5 is several times greater than the value of the total impedance of the primary transfer portion. R5 is 200 MΩ in this example. This means that the current Io that flows to the ground via R5 is several times smaller than the current It1 that flows to the primary transfer portion (Io<<It1). The value of R6 is smaller than R5, and is 800 kΩ in this example.

Critical here is that a desired primary transfer voltage Vt1 cannot be maintained if current does not flow to the transistor Q1. As illustrated in FIG. 3, it is assumed that the current supplied from the secondary transfer portion is It2, the current that flows to the primary transfer portion is It1, the current that flows to the transistor Q1 is Iq, and the current, which generates the monitor voltage V+ and flows to the ground via the resistor R5, is Io. In this case, It2=It1+Iq+Io, and if It2 is completely consumed for It1 and Ito, then Iq becomes 0, and in this state, the actual primary transfer voltage Vt1 no longer changes even if the setting voltage Vs is changed. In other words, if the current and voltage supplied from the secondary transfer portion to the primary transfer portion become insufficient and current does not flow to the transistor Q1, the transistor Q1 cannot maintain the potential. Hence even if V− is changed, the setting voltage Vs and the actual primary transfer voltage Vt1 do not match. To prevent this state, sufficient current must be supplied from the secondary transfer portion during the primary transfer. As the setting voltage Vs is set higher, the current that flows to the primary transfer portion increases, and therefore the current value supplied from the secondary transfer portion must be increased. Needless to say, the secondary transfer voltage is higher than the primary transfer voltage.

In this example, the PWM signal sent from the controller is used to control the control voltage V−, but the present invention is not limited to this, and a similar effect can be obtained even if the D/A port of the controller is used, for example.

Figure 4:
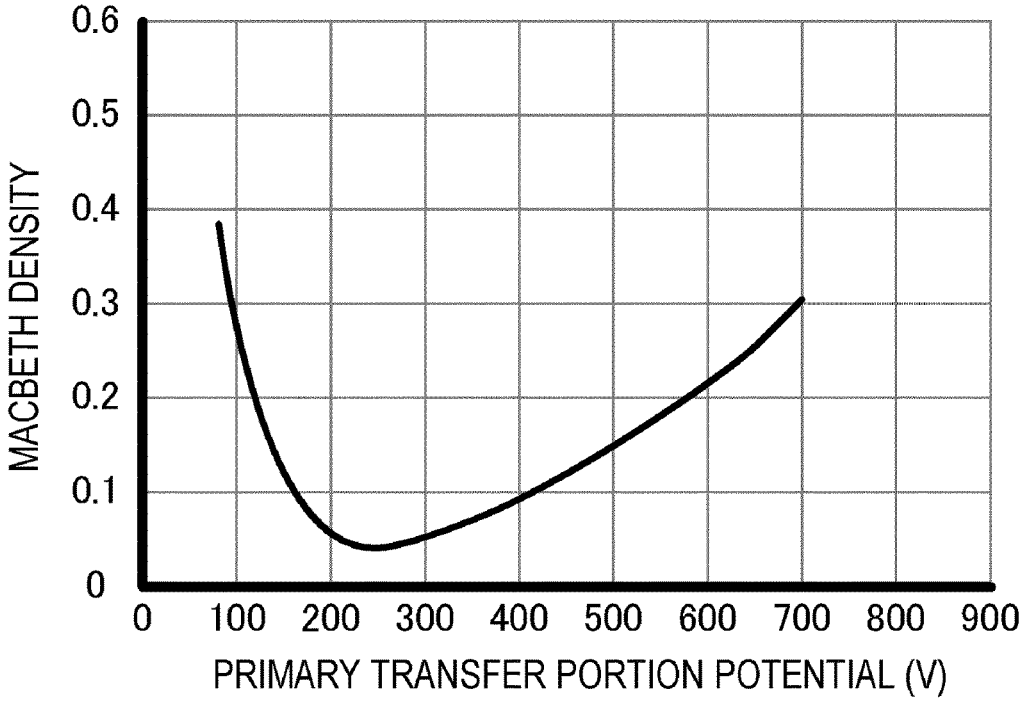
FIG. 4 is a graph depicting a relationship of an intermediate transfer belt potential and transfer efficiency according to Example 1.

FIG. 4 is a result of measuring the transfer efficiency in the primary transfer portion in the configuration of this example. The value of the transfer efficiency on the ordinate indicates the result of measuring the primary transfer residual toner density measured by a Macbeth densitometer (made by GretagMacbeth GmbH), and as this value becomes greater, the primary transfer residual toner density increases, and transfer efficiency drops. The measurement conditions in FIG. 4 are: the photosensitive drum 1 and the intermediate transfer belt 10 are brand new; and the environment is 23° C. and 50% RH, that is a normal temperature/normal humidity (N/N) environment. Under these conditions, the primary transferability is best when the primary transfer potential is 250 V.

Figure 5A:
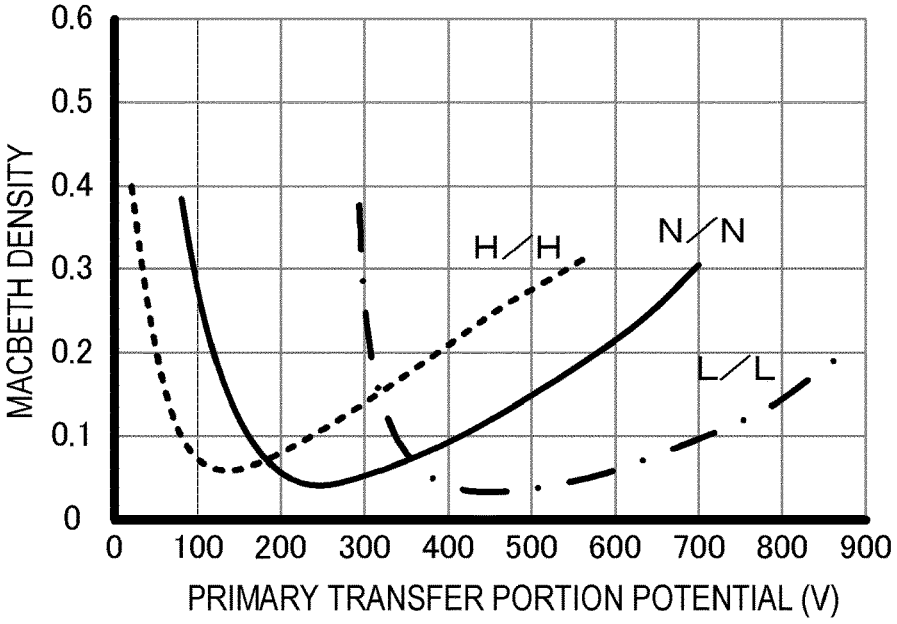
FIGS. 5A and 5B are graphs depicting the change of transfer efficiency according to Example 1.
Figure 5B:
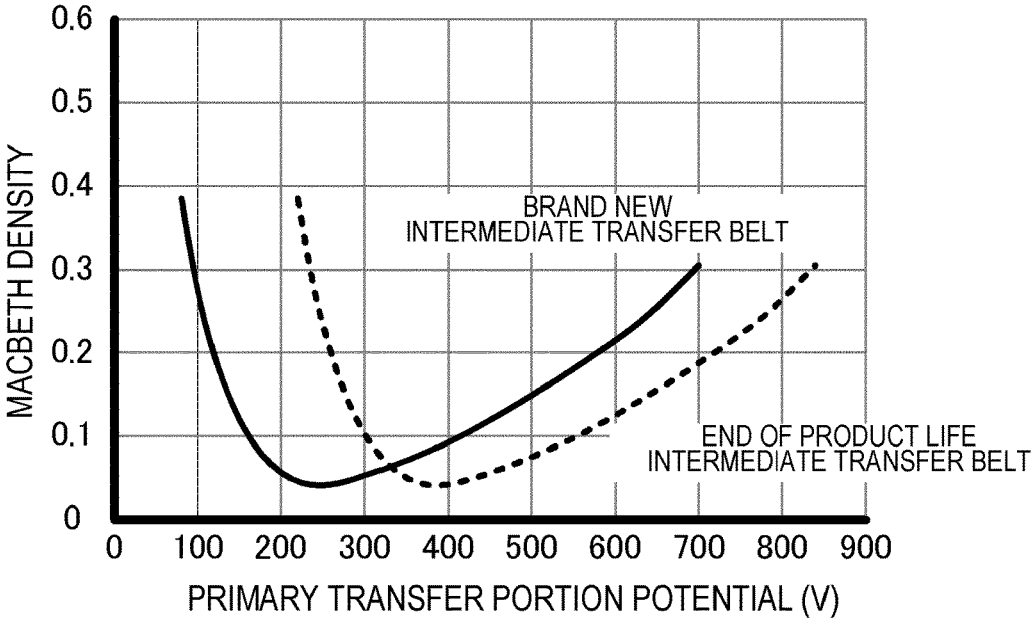

As shown in FIGS. 5A and 5B, in the configuration of this example, the transfer efficiency is changed by the environmental changes and durability changes of the resistance value of the intermediate transfer belt 10.

FIG. 5A is a graph depicting the transfer efficiency with respect to the environmental changes of the resistance value of the intermediate transfer belt 10. The optimum transfer efficiency is obtained at a low voltage in a high temperature/high humidity environment (H/H: 30° C., 80% RH), and at a high voltage in a low temperature/low humidity environment (L/L: 15° C., 10% RH).

FIG. 5B is a graph depicting the transfer efficiency with respect to the durability changes of the resistance value of the intermediate transfer belt 10. As the number of printed pages increases, in other words, as the number of times of image formation increases, resistance of the intermediate transfer belt 10 of this example increases, and the voltage to obtain the optimum transfer efficiency increases.

Another factor causing a change in the impedance is the wear of the photosensitive drum 1. The photosensitive drum 1 wears out and the film thickness of the drum decreases as the duration of use, in other words, the number of times of use for image formation increases. As the film thickness of the photosensitive drum decreases, the electrostatic capacity of the photosensitive drum increases accordingly, and as a result, impedance of the primary transfer portion tends to decrease. Therefore an increase in the number of times of use of the photosensitive drum 1 also causes a change in the primary transfer portion, and a change in the optimum transfer voltage.

The primary transfer voltage that is used when the image is output (optimum primary transfer voltage) can be determined by measuring the impedance of the primary transfer portion. The impedance is determined by measuring the primary transfer voltage Vt1, which allows a desired primary transfer current to flow when a solid white image (−500 V surface potential is uniformly formed on the entire photosensitive drum surface without any exposed portion) is transferred. The primary transfer current that flows at this time is called the "target current It". How smoothly the current flows differs depending on the image print percentage, hence when the impedance is measured, the solid white image is always used (the primary transfer operation is performed after setting the entire surface of the photosensitive drum to the potential of the non-exposure portion, to which toner does not adhere).

In the case of an image forming apparatus which has a dedicated power supply for the primary transfer, the primary transfer setting voltage Vs can be determined by supplying the target current It from the power supply for the primary transfer to the primary transfer portion, and reading the voltage at this time. However, in the case of the configuration of the image forming apparatus of this example, in which the dedicated power supply for the primary transfer is not included, the current flowing to the primary transfer portion cannot be measured directly, even if the potential of the primary transfer portion can be changed using the current supplied from the secondary transfer portion. Therefore in this example, the primary transfer voltage, with respect to the target current, is determined by the following method.

Before forming an image, the intermediate transfer belt 10 and the photosensitive drums 1*a* to 1*d* are rotated, and the target current It (e.g. 31 μA) plus the current corresponding to Io, that is, Io=Vt/(R5+R6)≈Vt/R5 (R6 can be ignored since R5>>R6), is supplied from the secondary transfer portion. While changing the setting voltage Vs of the transistor Q1 from 0 V to 600 V, actual primary transfer potential Vt1 is monitored (calculated (acquired) based on the monitor voltage V+ which the controller 100 can monitor). When the setting voltage Vs is low, the primary transfer current supplied by the primary transfer voltage Vt1 is lower than the target current, hence excess current (Iq) can be supplied to the transistor Q1, and the primary transfer potential Vt1 indicates a value similar to the setting voltage Vs of the transistor. However, if the setting voltage Vs is increased, the current corresponding to the target current It flows to the primary transfer portion, excess current is not supplied to the transistor Q1 (Iq=0), and at a certain point, the actual primary transfer potential Vt1 no longer increases even if the setting voltage Vs is increased. Table 1 shows the value of each current when the setting voltage Vs is changed.

TABLE 1

Relationship of Setting Voltage Vs and Each Current Value of This Example

| Vs (V) | It2 (μA) | It1 (μA) | Iq (μA) | Io (μA) |
|---|---|---|---|---|
| 200 | 32 | 13 | 18 | 1 |
| 400 | 33 | 31 | 0 | 2 |
| 600 | 34 | 31 | 0 | 3 |

Figure 6:
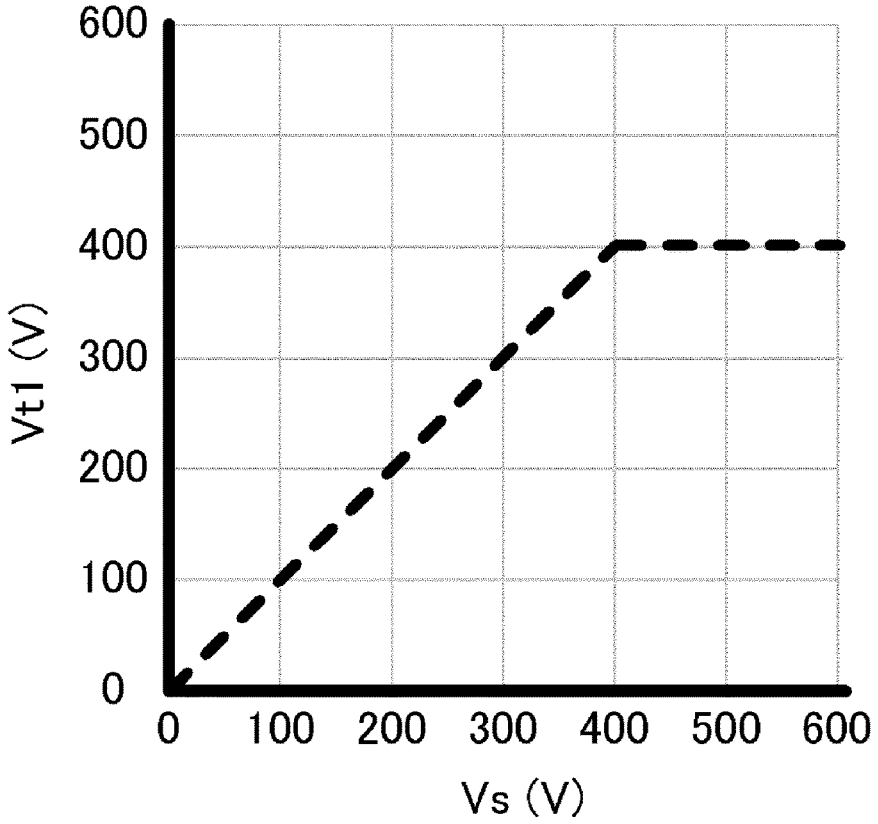
FIG. 6 is a graph depicting a relationship of a setting voltage and an actual primary transfer voltage according to Example 1.

FIG. 6 shows the relationship between the setting voltage Vs and the primary transfer voltage Vt1. A distinct changing point is observed at the setting voltage 400 V, and this changing point corresponds to the primary transfer voltage when the entire target current It is supplied to the primary transfer portion (in other words, the impedance of the primary transfer portion can be acquired based on the relationship between the target current It and the primary transfer voltage). This means that the setting voltage at this changing point (Vs=400 V) can be determined as the primary transfer voltage that is used during printing (that is, the magnitude of the control signal (PWM signal) for generating the primary transfer voltage can be determined). In concrete terms, when the monitor voltage V+ which the controller 100 monitors no longer changes, or when the ratio of the change of the monitor voltage V+ becomes a predetermined value or less, this point is determined as the changing point. For example, if the increase of Vt1 becomes 2 V or less when the setting voltage Vs is sequentially increased by 10 V at each time, this point is determined as the changing point. The concrete setting value of the target current It (31 μA in this example) may be determined in advance by experiment or the like, as a value which can maintain a desired transfer efficiency even if an environmental change or durability change is generated.

Figure 7:
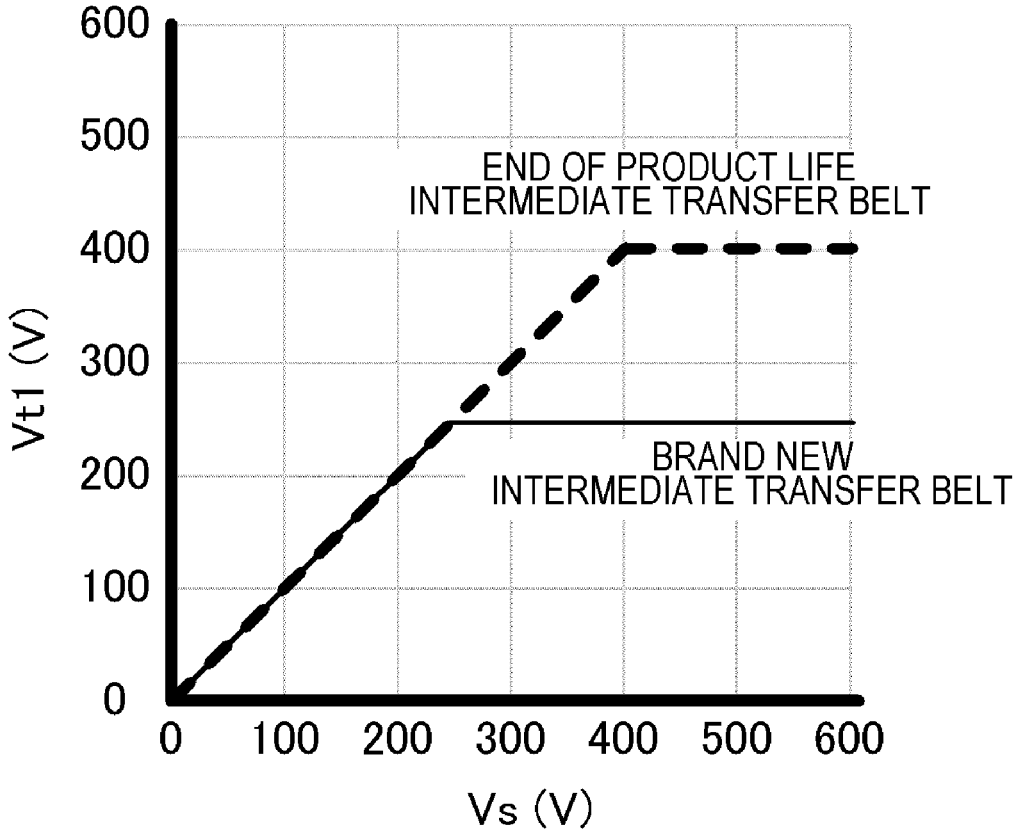
FIG. 7 is a graph depicting a relationship of a durability change of the intermediate transfer belt resistance and the primary transfer voltage according to Example 1.

FIG. 7 shows the relationship between the setting voltage Vs and the primary transfer voltage Vt1 when the intermediate transfer belt is brand new, and when the intermediate transfer belt is at the end of product life. The changing point is 250 V in the case of a brand new intermediate transfer belt, and is 400 V in the case of the intermediate transfer belt at the end of product life; therefore, these values become the primary transfer voltage values during printing, respectively. These voltage values roughly match with the voltage values to obtain the optimum transfer efficiency indicated in FIG. 5B. The optimum primary transfer voltage, with respect to the impedance change due to the changes in the environment and in drum film thickness, can also be determined by measuring the impedance in the same manner.

As described above, according to this example, the primary transfer voltage to supply the target current It can be determined in the apparatus configuration in which the primary transfer is performed using the power supply for secondary transfer. Thereby the optimum primary transfer voltage can be determined in accordance with the impedance change of the primary transfer portion, caused by a surrounding environment and the operating state of the intermediate transfer belt, and good primary transferability can be ensured.

In this example, the change of the primary transfer voltage is monitored while increasing the setting voltage of the transistor Q1 from 0 V to 600 V, but the primary transfer voltage may be determined while decreasing the setting voltage from 600 V to 0 V.

In this example, a transistor is used as the voltage adjusting member to adjust the voltage of the primary transfer portion, but the present invention is not limited to this, and may be another element, such as a digital volume element (digital variable resistor), which may be used if the same effect described above can be obtained.

Figure 8:
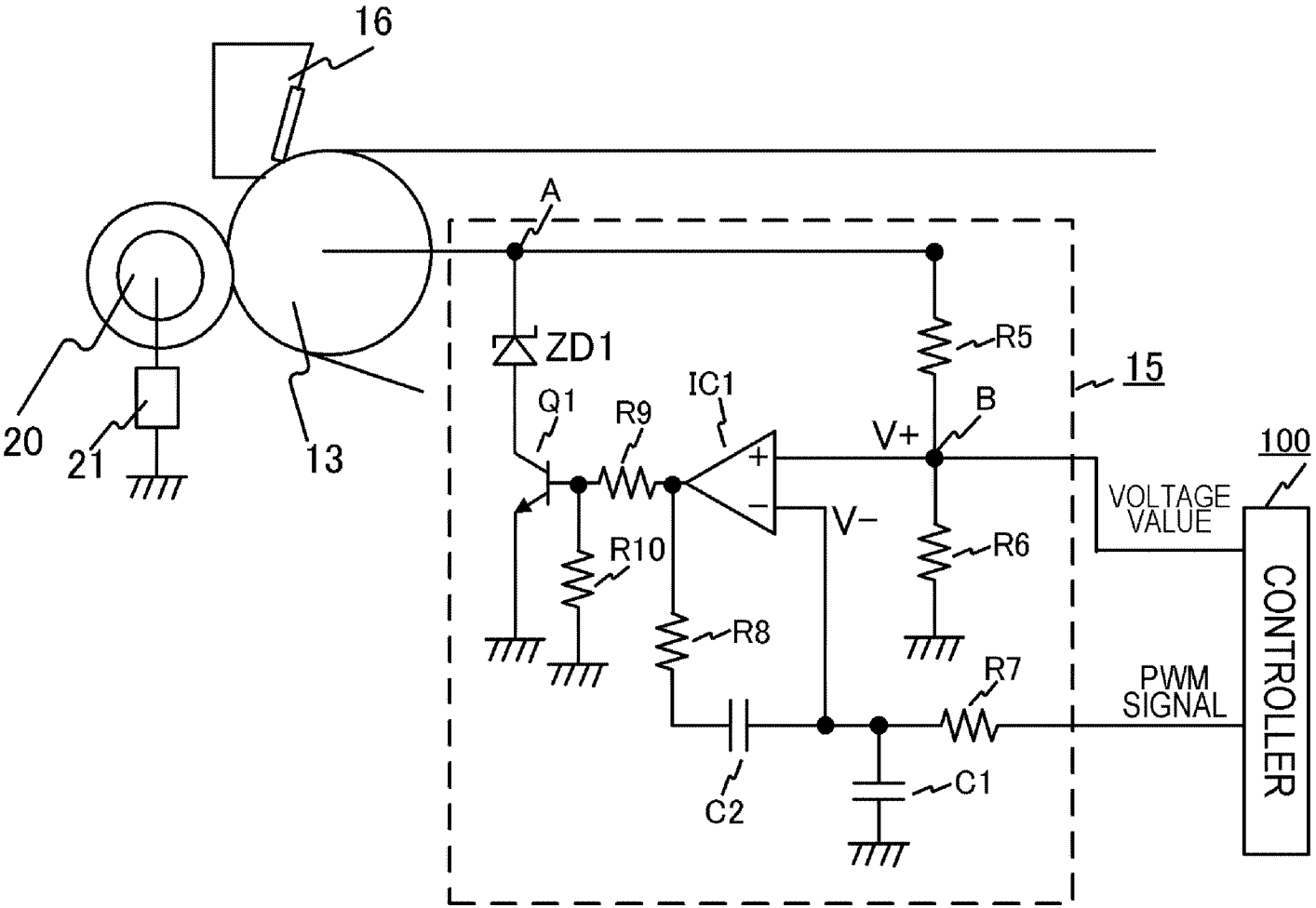
FIG. 8 is a diagram depicting another configuration example of the circuit according to Example 1.

As illustrated in FIG. 8, a configuration in which a Zener element (Zener diode) ZD1, which functions as the voltage maintaining element, connected with the transistor Q1 in series, may be used. If the Zener element, which can maintain a 200 V voltage, is used, the primary transfer voltage can be changed in a 200 V to 800 V range. In this way, the variable range of the primary transfer voltage can be changed in accordance with the range in which the impedance of the primary transfer portion changes.

Figure 9:
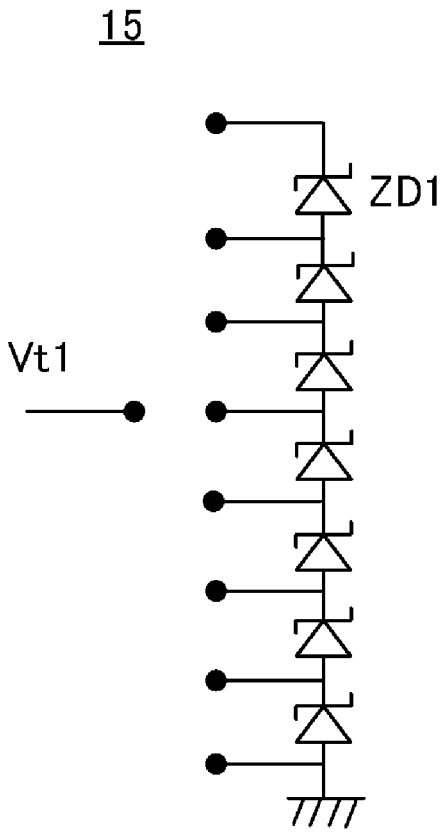
FIG. 9 is a diagram depicting another configuration example of the circuit according to Example 1.

Further, the primary transfer voltage may be changed by connecting the Zener elements ZD1 in series in a ladder configuration, as illustrated in FIG. 9, and changing the contact of the Zener elements and the primary transfer portion. In this case, the current supplied from the secondary transfer portion flows only to the primary transfer portion or to the Zener elements ZD1 (current corresponding to Io does not flow), hence the optimum voltage can be determined by supplying the target current It as a constant current.

In this example, the current supply member uses the voltage applied to the secondary transfer roller, but the present invention is not limited to this configuration.

Figure 10:
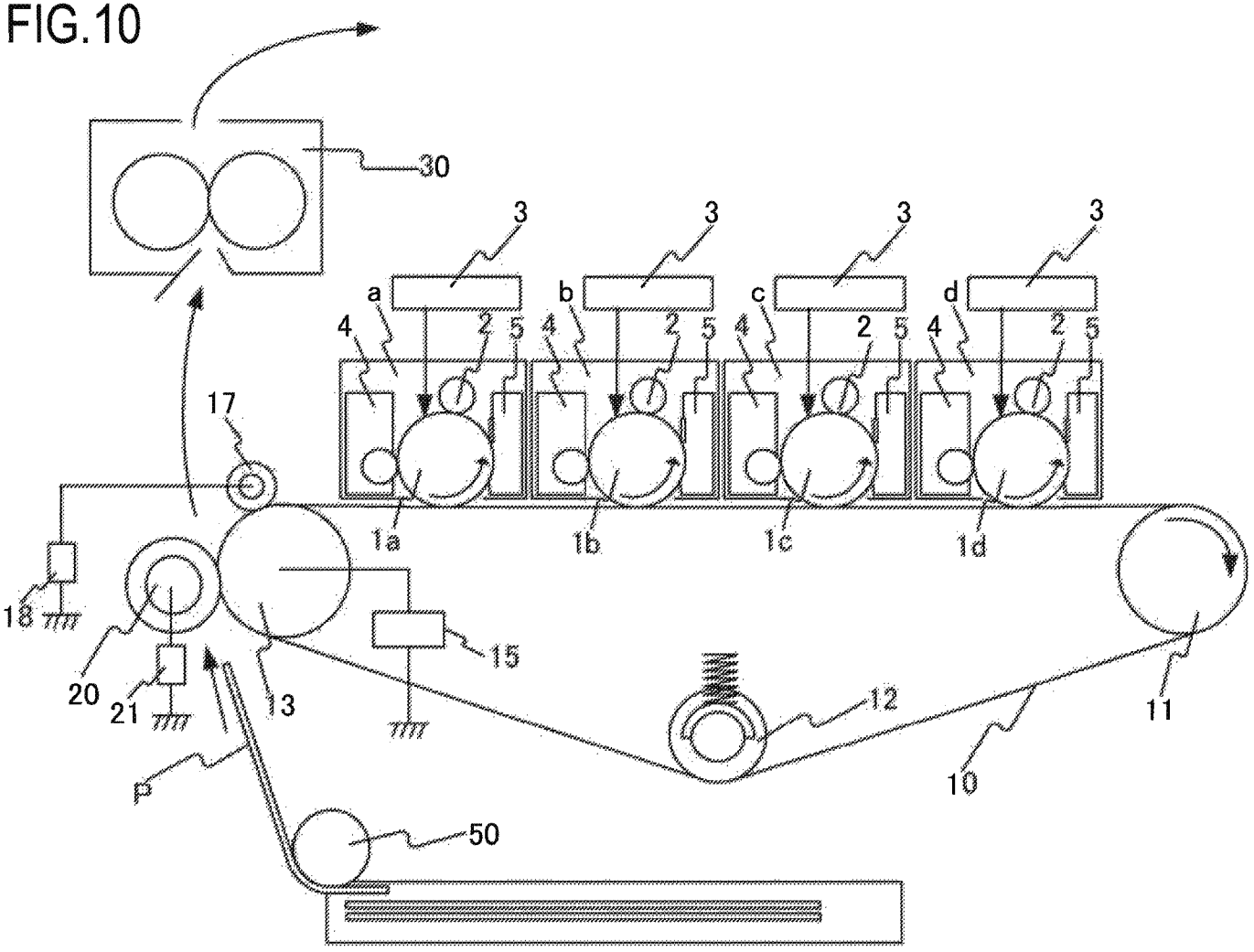
FIG. 10 is a diagram depicting another configuration example of Example 1.

As illustrated in FIG. 10, current generated by applying voltage from the power supply 18 to the cleaning roller 17, to charge the toner on the intermediate transfer belt, may be used. Further, for the current supply member, the current acquired by both the secondary transfer roller 20 and the cleaning roller 17 may be superimposed, since a similar effect can be obtained.

In this example, an apparatus which does not include the primary transfer member was described, but the present invention can also be applied to an apparatus which includes the primary transfer member.

Figure 11:
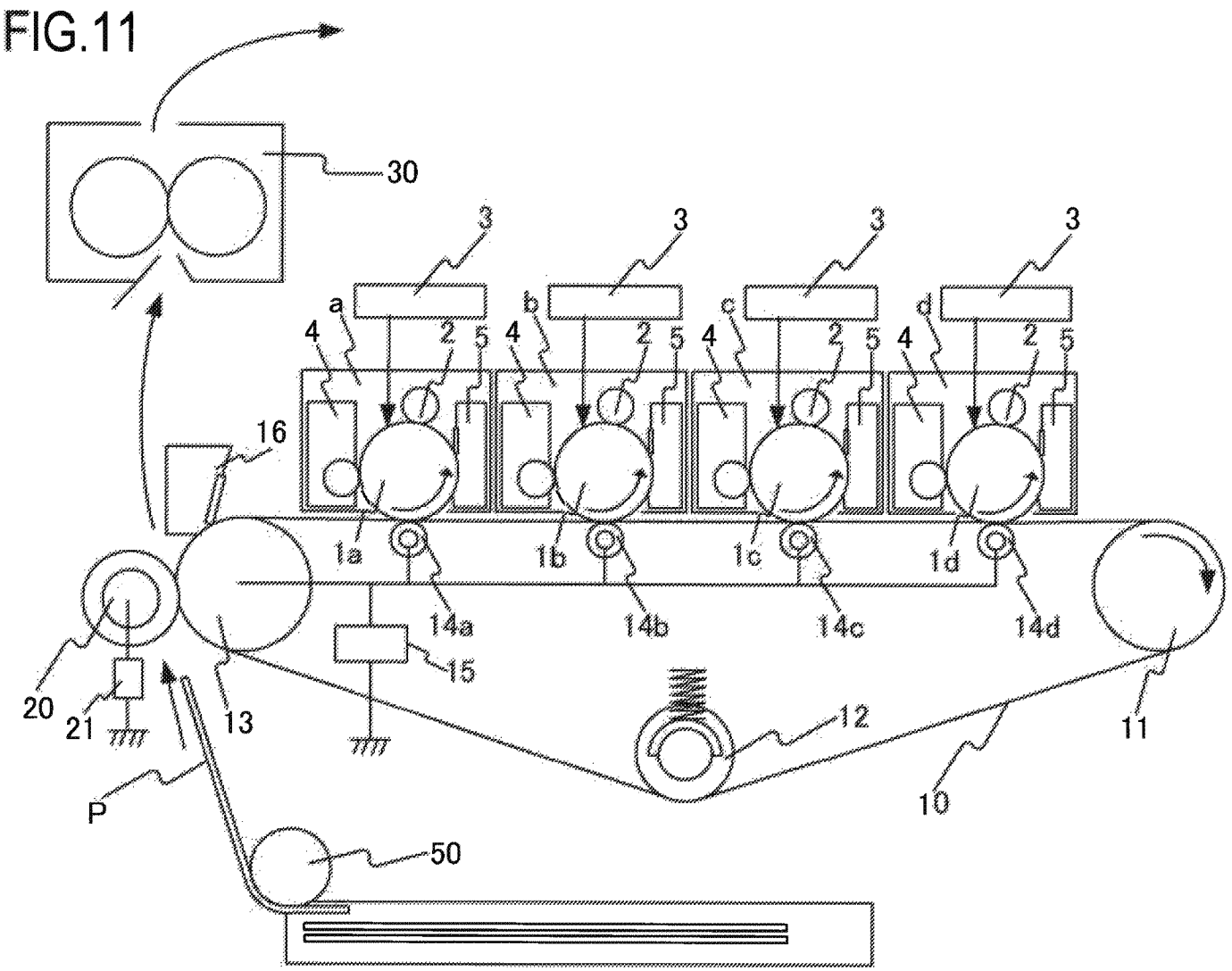
FIG. 11 is a diagram depicting another configuration example of Example 1.

In other words, the present invention can also be applied to a configuration in which the secondary transfer counter roller 13 is electrically connected with the primary transfer members 14*a*, 14*b*, 14*c* and 14*d*, so that current is supplied from the secondary transfer portion to the primary transfer members, as illustrated in FIG. 11, and a similar effect can be obtained in this case as well. For the primary transfer member, a roller type, a sheet type, or a brush type conductive member, for example, can be used.

In this example, in the non-image forming state, the sequence of determining the primary transfer voltage before forming the image is used, but the sequence need not be performed every time an image is formed, but may be performed once every 20 pages of printing, for example. Further, in the non-image forming state after an image is formed, this determination sequence may be performed as a preparation for the next image formation. Furthermore, in the non-image forming state, this sequence may be performed at a timing when the photosensitive drum 1 or the intermediate transfer belt 10 is replaced, or immediately after the power of the main body is turned on, and be performed once every 100 pages of printing thereafter.

The configuration example and the method described above with reference to FIG. 8 to FIG. 11 can also be applied to the following Examples 2 to 4.

Example 2

An image forming apparatus according to Example 2 of the present invention will be described. In the configuration of Example 2, a composing element the same as Example 1 is denoted with the same reference sign, and description thereof is omitted.

Figure 12:
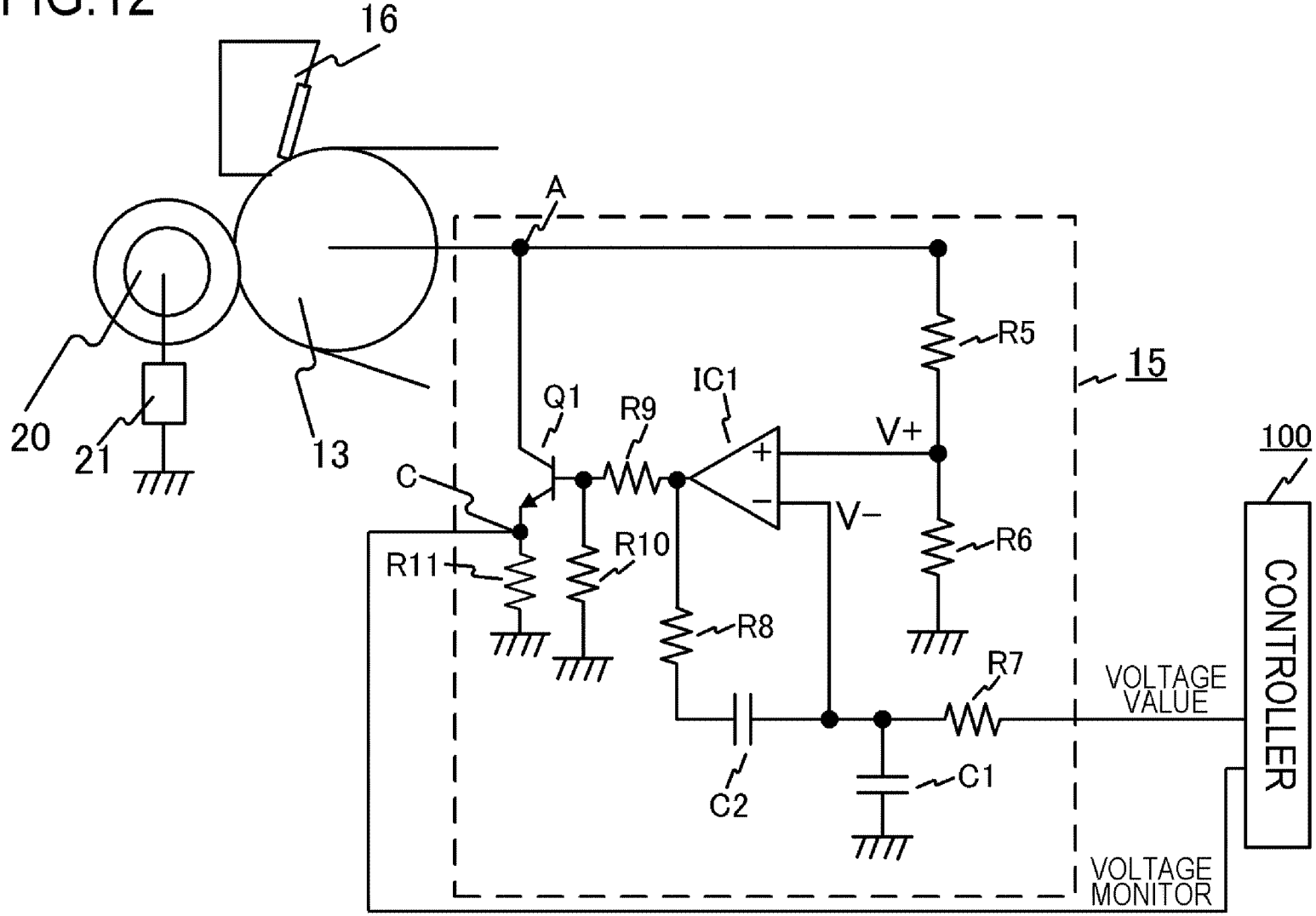
FIG. 12 is a diagram depicting a circuit of a primary transfer portion according to Example 2.

FIG. 12 is a diagram depicting a circuit configuration of a primary transfer portion according to Example 2. In the configuration of Example 1, the actual primary transfer potential Vt1 is monitored by reading the value of the monitor voltage V+, which is input to the input terminal of the operational amplifier IC1, using the controller 100. In Example 2, on the other hand, a resistor R11 is disposed between the transistor Q1 and the ground, as illustrated in FIG. 12, and the voltage (potential) VR at point C between the resistor R11 and the transistor Q1 is read, whereby the presence of the current which flows from the transistor Q1 to the ground is detected. The resistance value of VR that is used here is small enough to hardly influence Vt1, such as 100 kΩ. In this example, the controller 100 connected to point C corresponds to the control portion of the present invention, and also functions as the detecting portion which detects the presence of the current which flows from the voltage adjusting member to the ground.

As in Example 1, the intermediate transfer member and the photosensitive drums are rotated before forming an image, and the total current (It+Vt/(R5+R6)) of the target current It and the current Io to form the monitor voltage V+ is supplied from the secondary transfer portion. In this example, however, Vt1 cannot be monitored, hence the setting voltage Vs is used instead of the actual primary transfer voltage Vt, and (It+Vs/(R5+R6)) is supplied. At this time, the voltage VR at point C is monitored while changing the setting voltage of the transistor Q1 from 0 V to 600 V, whereby the presence of the current that flows from the transistor Q1 to the ground is determined.

If the setting voltage is low, the primary transfer current supplied by the primary transfer voltage is lower than the target current; therefore, excess current can be supplied to the transistor Q1, and the primary transfer potential Vt1 indicates a value similar to the setting voltage of the transistor. As the setting voltage is increased, the entire target current flows to the primary transfer portion, excess current is not supplied to the transistor Q1, and at a certain point, the actual primary transfer potential Vt1 no longer increases even if the setting voltage is increased. At this time, the current that flows from the transistor Q1 to the ground also stops, and VR becomes zero.

Figure 13:
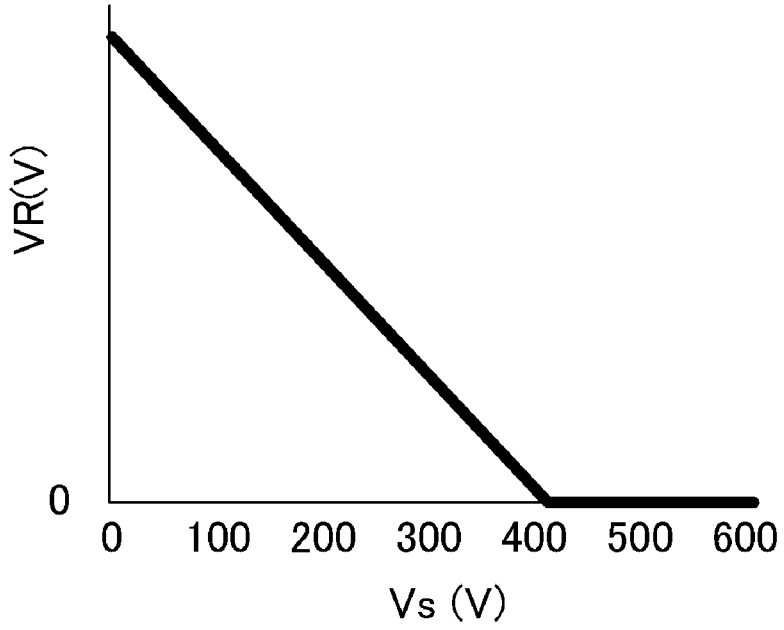
FIG. 13 is a graph depicting a relationship of a setting voltage and potential under a transistor according to Example 2.

FIG. 13 shows the relationship between the setting voltage and VR. Since VR becomes zero when the setting voltage is 400 V, the setting voltage 400 V corresponds to the primary transfer voltage when the entire target current is supplied to the primary transfer portion. In other words, it is determined that 400 V is the primary transfer voltage used for printing.

Example 3

An image forming apparatus according to Example 3 of the present invention will be described. In the configuration of Example 3, a composing element the same as the above examples is denoted with the same reference sign, and description thereof is omitted.

Figure 14:
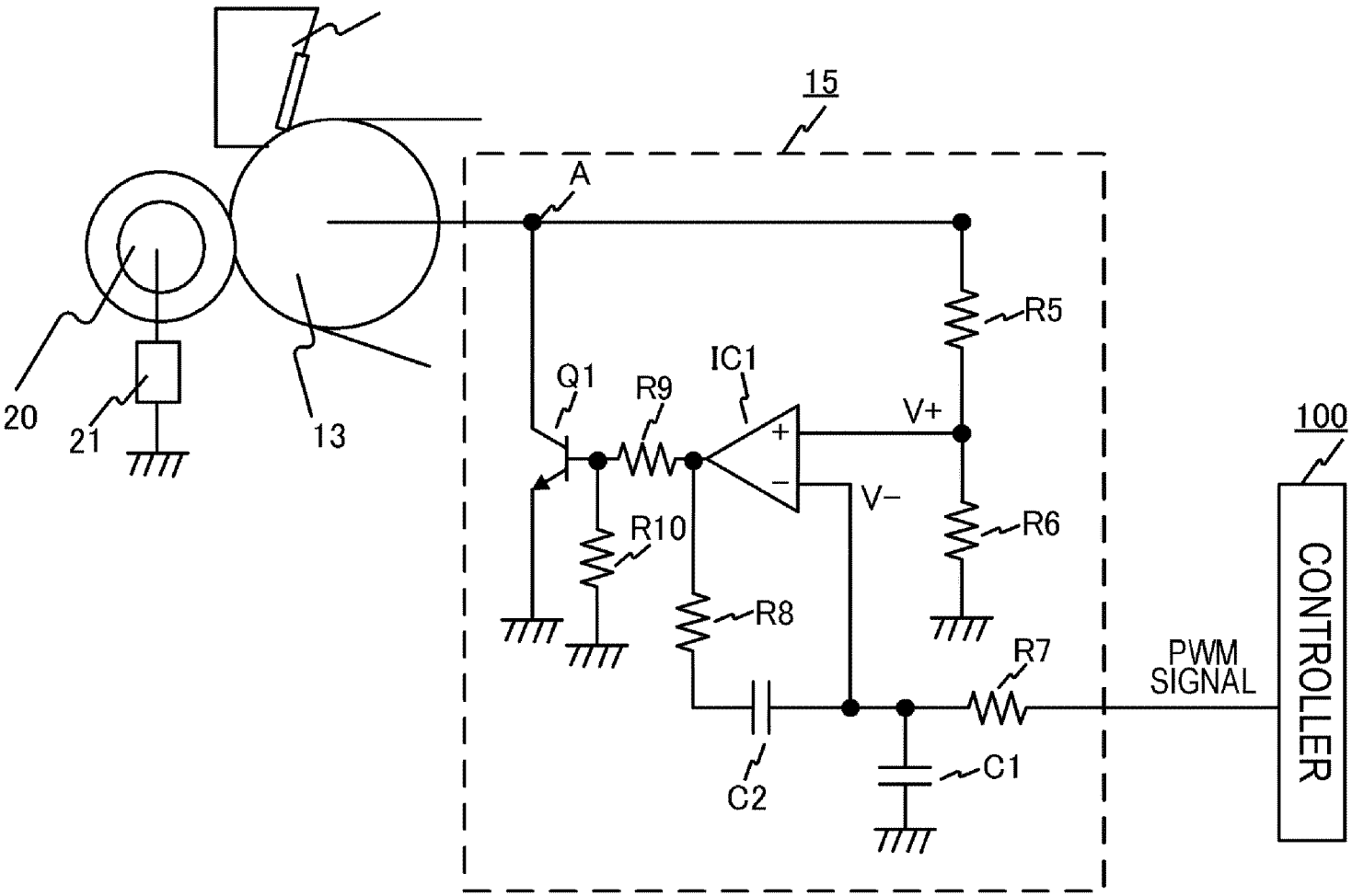
FIG. 14 is a diagram depicting a circuit of a primary transfer portion according to Example 3.

FIG. 14 shows a circuit configuration of a primary transfer portion according to Example 3 of the present invention. In this example, there is no signal line to monitor the actual primary transfer potential Vt by reading the value of V+ using the controller 100, and only the line to input the PWM signal connects the voltage adjusting circuit 15 and the controller 100, as illustrated in FIG. 14. Before forming the image, the intermediate transfer belt 10 and the photosensitive drums 1*a* to 1*d* are rotated, and the total current (It+Vs/(R5+R6)) of the target current It (31 μA) and the current Io to generate the monitor voltage V+ is supplied from the secondary transfer portion while referring to the setting voltage Vs, as in Example 2. At this time, the voltage Vt2 of the secondary transfer power supply 21 (potential of the secondary transfer roller 20) is monitored while changing the setting voltage of the transistor Q1 from 0 V to 600 V. The secondary transfer voltage Vt2 (potential of the secondary transfer roller 20) is monitored by the controller 100 using voltage/current detecting circuits included in the secondary transfer power supply 21. In this example, the voltage/current detecting circuits, included in the secondary transfer power supply 21 which is used to detect the secondary transfer voltage Vt2, and the controller 100 connected to these circuits, corresponds to the control portion of the present invention, and also plays the function of the detecting portion to detect the potential of the current supply member.

Figure 15:
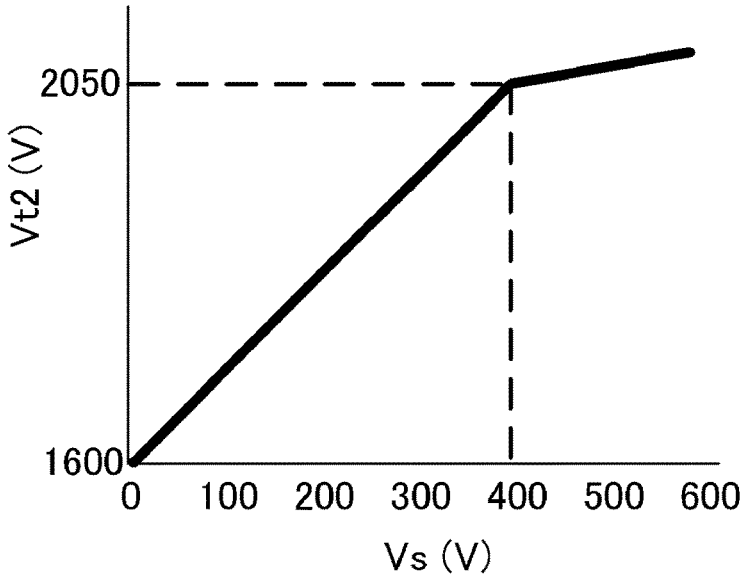
FIG. 15 is a graph depicting a relationship of the setting voltage and the secondary transfer voltage according to Example 3.

FIG. 15 shows the relationship between the setting voltage Vs of the transistor Q1 and the secondary transfer voltage Vt2. The primary transfer voltage Vt1 is the same as the potential of the secondary transfer counter roller 13, and the secondary transfer current amount is determined by the difference of the potential of the secondary transfer counter roller 13 and the secondary transfer voltage Vt2. Therefore when the primary transfer setting voltage is low, the actual primary transfer voltage Vt1 and the potential of the secondary transfer counter roller 13 increase as the setting voltage increases, and the secondary transfer voltage Vt2 also increases accordingly. When the primary transfer current reaches the target current, and the actual primary transfer voltage Vt1 and the potential of the secondary transfer counter roller 13 no longer increase even if the setting voltage Vs is increased, the rise of the secondary transfer voltage Vt2 stops. Then the secondary transfer voltage Vt2 slightly rises for the following reason. In this example, the supply current from the secondary transfer portion is (It+Vs/(R5+R6)) with reference to Vs, and when the setting voltage Vs>400, the actual primary transfer voltage Vt1 becomes constant, but the supply current amount slightly increases.

As a result, the changing point depicted in FIG. 15 is generated, and the setting voltage Vs of the changing point can be determined as the voltage value to supply the target current It to the primary transfer portion. To detect the changing point, the point when the ratio of the change of the detected secondary transfer voltage Vt2 becomes a predetermined ratio or less, is determined as the changing point, and, for example, the point when the slope of Vt2 with respect to Vs changes to ½ or less is detected.

Compared with Example 1 and 2, this example can decrease the number of signal lines of the voltage adjusting circuit 15, but, on the other hand, an error (e.g. error caused by uneven resistance in the secondary transfer circumferential direction) is more easily generated, since the changes of the primary transfer voltages Vt1 are measured indirectly. This problem of detection error can be improved by optimizing the number of samples of data and time used for each sampling.

As described in Example 1, for the current supply member to supply current to the primary transfer portion, the cleaning roller 17 to charge the toner on the intermediate transfer belt 10, as illustrated in FIG. 10, may be utilized. In this case, the target current is supplied using the cleaning roller 17 when an image is not formed, and the voltage applied to the cleaning roller 17 is monitored while changing the setting voltage Vs, whereby the setting voltage can be determined in the same manner.

Example 4

An image forming apparatus according to Example 4 of the present invention will be described. In the configuration of Example 4, a composing element the same as the above examples is denoted with the same reference sign, and description thereof is omitted.

In this example, the configuration of the voltage adjusting circuit 15 is similar to that in Example 1 (FIG. 3), but the way of monitoring the actual primary transfer voltage Vt1 before an image is formed is different. In concrete terms, the total current (0.5It+Vt/(R5+R6)) of ½ the target current (15.5 μA) and the current Io to generate the monitor voltage V+ is supplied from the secondary transfer portion to the primary transfer portion before an image is formed. Then the actual primary transfer potential Vt1 is monitored while changing the setting voltage Vs of the transistor Q1' from 0 V to 600 V.

Figure 16:
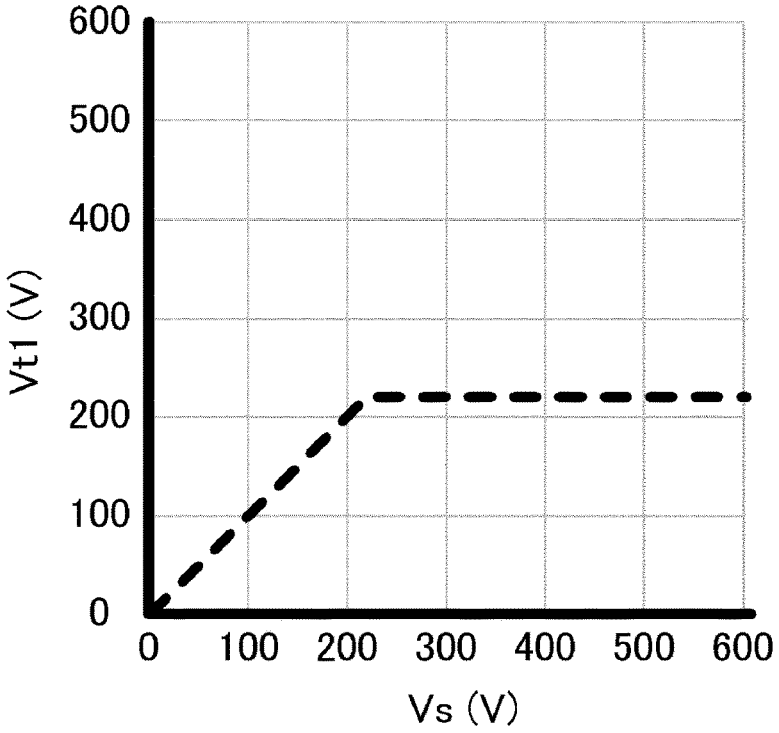
FIG. 16 is a graph depicting the relationship of the setting voltage and the primary transfer voltage according to Example 4.

As depicted in FIG. 16, a distinct changing point is observed when the setting voltage is 225 V, which means that the voltage to supply a 15.5 μA current to the primary transfer portion is 225 V.

Figure 17:
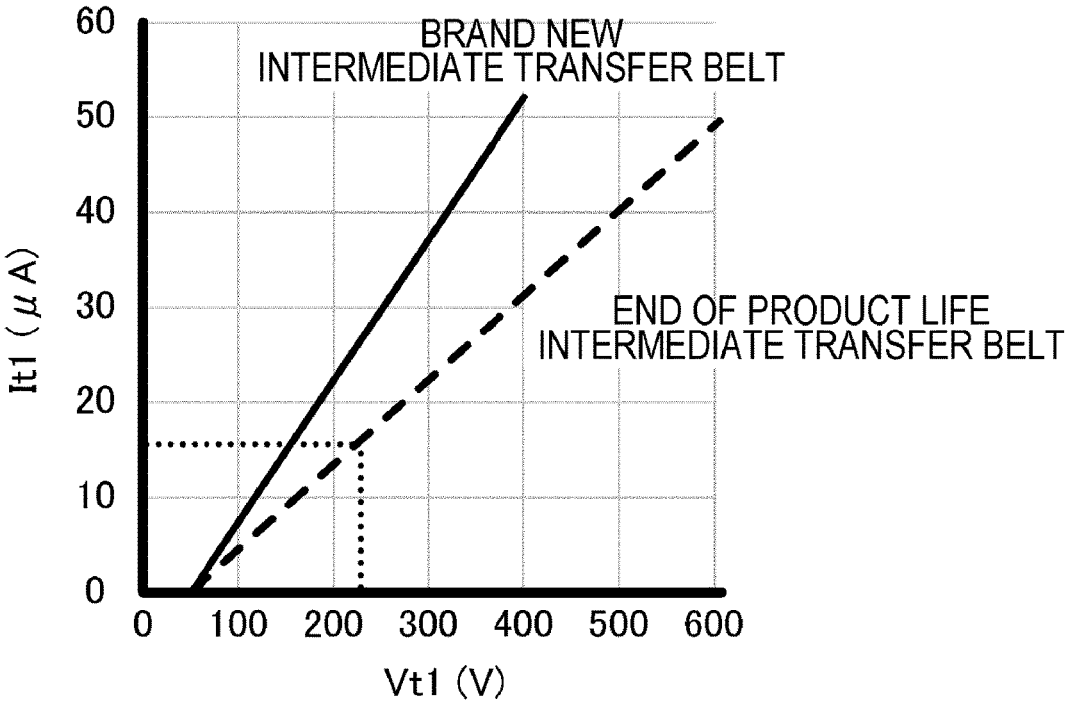
FIG. 17 is a graph depicting the relationship of the primary transfer voltage and the primary transfer current according to Example 4.

FIG. 17 shows the relationship between the primary transfer voltage Vt1 and the primary transfer current It1 in the image forming apparatus of this example. The current starts to flow when the transfer voltage is 50 V, and the current value linearly increases there from therefrom as the voltage increases, and the slope of the current value changes as the resistance of the intermediate transfer belt 10 changes. Therefore, if the primary transfer voltage when the current value is ½ the target current is known, the primary transfer voltage when the target current is supplied can be determined by calculation. In this case (225-50)×2+50=400 V, and the primary transfer voltage when printing the image is determined as 400 V. In other words, the changing point of the primary transfer voltage (magnitude of the corresponding control signal) is acquired using the current determined by dividing the target current by a predetermined number, and the changing point in the case when the target current is not divided by the predetermined number is calculated based on the acquired changing point.

In this example, the predetermined number by which the target current is divided is 2, that is, the impedance of the primary transfer portion is measured after ½ the target current is supplied from the secondary transfer portion, but the number by which the target current is divided is not especially limited. The same procedure may be performed using ⅓ or ¼ the current value, whereby the optimum primary transfer voltage may be determined by calculation. However, if the current value used for the measurement is excessively lower than the target current value, the measurement error increases, and the result is more likely to deviate from the actual value, hence caution is necessary.

In this example, the measurement time can be decreased compared with Example 1. The same procedure as this example may be performed in Examples 2 and 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-253133, filed on Dec. 27, 2016, which is hereby incorporated by reference herein in its entirety.

What is claimed is:

1. An image forming apparatus, comprising:

an image bearing member that bears a developer image;

an endless belt that rotates while contacting the image bearing member;

a current supply member that contacts the belt, with respect to a rotating direction of the belt, at a position different from the position where the image bearing member contacts the belt, and that supplies current to the belt;

a control portion that outputs a control signal, the magnitude of which is variable;

a contact member that contacts the belt; and a voltage adjusting portion that includes a voltage adjusting member connected to the contact member, the voltage adjusting portion being capable of changing the magnitude of the control signal that is input from the control portion, and capable of changing a magnitude of a transfer potential, which is a surface potential of the belt at a contact portion with the image bearing member and is a potential to transfer the developer image borne by the image bearing member to the belt, wherein in a non-image forming state in which image formation to form an image on a recording material is not performed, the image forming apparatus changes the magnitude of the control signal output by the control portion, and when the current supply member supplies the belt with an amount of current generated by adding, to a predetermined target current used for the image formation, an amount of current that flows from the contact member to the ground and changes in accordance with the magnitude of the control signal, the image forming apparatus acquires the magnitude of the control signal generated when the current, which is supplied from the current supply member to the belt and flows to the voltage adjusting member from the belt via the contact member, becomes zero, and the image forming apparatus performs the image formation using the control signal having the acquired magnitude.

2. The image forming apparatus according to claim 1, further comprising a detecting portion that detects a potential of the contact member, wherein in the non-image forming state, the image forming apparatus changes the magnitude of the control signal output by the control portion, and when the current supply member supplies the belt with the amount of current generated by adding, to the predetermined target current used for the image formation, the amount of current that flows from the contact member to the ground and changes in accordance with the magnitude of the control signal, the image forming apparatus acquires, as the magnitude of the control signal generated when the current flowing to the voltage adjusting member becomes zero, the magnitude of the control signal generated when a magnitude of the potential of the contact member detected by the detecting portion no longer changes, or when a ratio of the change of the potential becomes a predetermined value or less.

3. The image forming apparatus according to claim 1, further comprising a detecting portion that detects the presence of current flowing from the voltage adjusting member to the ground, wherein in the non-image forming state, the image forming apparatus changes the magnitude of the control signal output by the control portion, and when the current supply member supplies the belt with the amount of current generated by adding, to the predetermined target current used for the image formation, the amount of current that flows from the contact member to the ground and changes in accordance with the magnitude of the control signal, the image forming apparatus acquires, as the magnitude of the control signal generated when the current flowing to the voltage adjusting member becomes zero, the magnitude of the control signal generated when the detecting portion detects that the current flowing from the voltage adjusting member to the ground becomes zero.

4. The image forming apparatus according to claim 1, further comprising:

a power supply that applies voltage to the current supply member, the power supply being capable of changing the voltage to be applied so that an amount of current supplied from the current supply member to the belt can be changed; and a detecting portion that detects a potential of the current supply member, wherein in the non-image forming state, the image forming apparatus changes the magnitude of the control signal output by the control portion, and when the current supply member supplies the belt with the amount of current generated by adding, to the predetermined target current used for the image formation, the amount of current that flows from the contact member to the ground and changes in accordance with the magnitude of the control signal, the image forming apparatus acquires, as the magnitude of the control signal generated when the current flowing to the voltage adjusting member becomes zero, the magnitude of the control signal generated when a ratio of the change of the potential of the current supply member detected by the detecting portion becomes a predetermined ratio or less.

5. The image forming apparatus according to claim 1, wherein the image forming apparatus changes the magnitude of the control signal output by the control portion, and when the current supply member supplies the belt with an amount of current generated by adding, to an amount of current determined by dividing the target current by a predetermined number, an amount of current that flows from the contact member to the ground and changes in accordance with the magnitude of the control signal, the image forming apparatus acquires the magnitude of the control signal generated when the current, which is supplied from the current supply member to the belt and flows to the voltage adjusting member from the belt via the contact member, becomes zero, and from this magnitude of the control signal, the image forming apparatus acquires the magnitude of the control signal which is determined in the case when the target current is not divided by the predetermined number.

6. The image forming apparatus according to claim 1, wherein the control signal is a PWM signal, and the voltage adjusting portion changes a magnitude of the current supplied from the current supply member to the belt in accordance with a value of a duty ratio of the PWM signal that is input from the control portion.

7. The image forming apparatus according to claim 1, wherein the voltage adjusting portion is an adjusting circuit including a transistor which functions as the voltage adjusting member.

8. The image forming apparatus according to claim 1, wherein the voltage adjusting portion is connected to the belt via a support member, which supports the belt and functions as the contact member.

9. The image forming apparatus according to claim 8, further comprising a voltage maintaining element which is connected between the support member and the voltage adjusting portion, wherein the magnitude of the transfer potential to transfer the developer image borne by the image bearing member to the belt is a magnitude determined by superimposing a predetermined potential maintained by the voltage maintaining element and the potential which is variably adjusted by the voltage adjusting portion.

10. The image forming apparatus according to claim 9, wherein the voltage maintaining element is a Zener diode.

11. The image forming apparatus according to claim 1, wherein the current supply member is a secondary transfer member that secondarily transfers the developer image from the belt to the recording material using the current that is supplied to the contact portion with the belt.

12. The image forming apparatus according to claim 1, further comprising a second current supply member which contacts the belt at a position different from the positions where the image bearing member and the current supply member contact the belt, wherein current, which is generated by superimposing current that is supplied from the current supply member to the belt and current that is supplied from the second current supply member to the belt, flows to the contact portion of the belt with the image bearing member.

13. The image forming apparatus according to claim 12, wherein the second current supply member is a charging member to charge the toner carried on the belt.

14. The image forming apparatus according to claim 1, wherein the current supply member is a charging member to charge the toner carried on the belt.

15. The image forming apparatus according to claim 1, wherein the belt is an endless belt body molded by mixing an ionic conductive agent.

* * * * *